United States Patent [19]

Sato

[11] 4,094,724

[45] June 13, 1978

[54] LABEL CUTTING DEVICE FOR LABEL APPLYING MACHINE

[75] Inventor: Yo Sato, Tokyo, Japan

[73] Assignee: Kabushiki Kaisha Sato Kenkyusho, Tokyo, Japan

[21] Appl. No.: 730,121

[22] Filed: Oct. 6, 1976

[30] Foreign Application Priority Data

Oct. 18, 1975 Japan ..... 50-124892

[51] Int. Cl.[2] ..... B41M 1/00

[52] U.S. Cl. ..... 156/384; 156/510; 156/517; 156/DIG. 33; 156/DIG. 49

[58] Field of Search ..... 156/277, 384, 510, 540, 156/541, 542, 517, 521, DIG. 24, DIG. 37, DIG. 33, DIG. 48, DIG. 49, 250, 256, 577, 579; 101/69, 93.07

[56] References Cited

U.S. PATENT DOCUMENTS

| | | | |
|---|---|---|---|
| 3,159,521 | 12/1964 | Pechmann | 156/DIG. 33 |
| 3,245,860 | 4/1966 | Aurich et al. | 156/517 |
| 3,265,553 | 8/1966 | Kind et al. | 156/517 |

FOREIGN PATENT DOCUMENTS

| | | | |
|---|---|---|---|
| 642,881 | 2/1937 | Germany | 156/521 |
| 12,505 | 4/1972 | Japan | 156/521 |

*Primary Examiner*—Caleb Weston

*Attorney, Agent, or Firm*—Ostrolenk, Faber, Gerb & Soffen

[57] ABSTRACT

A label cutting device for a label applying machine including: a label strip advancing roller which is provided at regular intervals around its periphery with label strip engaging and advancing pawls and also with cutting blade receiving grooves, a cutting blade supported at a cutting position next to the label advancing roller, the label strip held on the label advancing roller is cut by the cutting blade being moved into one of the grooves of the roller by the operation of the hand lever of the machine through an intermediate linkage.

26 Claims, 11 Drawing Figures

41
40

21
22
28
22
30
30
60
23
64

39
36
35a
39
36
35b
39
31
39

LABEL CUTTING DEVICE FOR LABEL APPLYING MACHINE

BACKGROUND OF THE INVENTION AND DESCRIPTION OF THE PRIOR ART

This invention relates to a label cutting device, which is built into a label applying machine, for cutting an elongated strip of labels into unit label pieces. The label strip includes label strip advancement perforations in the form of cuts through the label strip which are formed at regular intervals. The connecting portions of the label strip next to the perforations are cut by the cutting device of the invention after the label strip is peeled from a backing paper.

For example, a device which performs this function is disclosed in the specifications of Japanese Pat. Nos. 664,065, entitled "Label Cutting Device in Label Applying Machine" and 664,072, entitled "Label Applying Machine" owned by the assignee hereof. In the latter patent, the label strip engaging and advancing roller has cutting blades arrayed around it at regular intervals. A vertically movable blade receiving block is moved toward and away from the blades 41 by the hand lever of the label applying machine.

However, when the label strip is cut by pressing the blade receiving block against the cutting blade, a number of disadvantages result. Great pressure must be exerted in order to cut the label strip. This apparatus press cuts and the cutting blade is often damaged, which interferes with the label application. Because the blade receiving block strikes against the cutting blade, impact sound is produced. Such noisy cutting devices are disliked by operators.

BRIEF SUMMARY OF THE INVENTION

The primary object of the present invention is to provide an improved, simplified cutting device for a label applying machine.

Another object of the present invention is to provide a label cutting device which is easily operated and kept in good order throughout long term use.

A further object of the present invention is to provide a label cutting device which can be operated quietly.

The label cutting device in accordance with the present invention has a label advancing roller whose peripheral surface is provided with one or more usually a plurality of label advancing pawls spaced at regular intervals around the roller and with a plurality of regularly spaced apart long blade receiving grooves which extend across the advancing roller. A movable cutting blade is supported next to the label advancing roller at a cutting position. The label strip is held against the peripheral surface of the label advancing roller at the cutting position and it is cut by insertion of the cutting blade into one of the long grooves of the roller through operation of the hand lever of the label applying machine.

In the label cutting device of the present invention, the label strip is cut through by each thrust of the cutting blade. With this device, the following advantages result:

A. The squeezing of the hand lever is made easy so that the fatigue of operator is reduced.

B. The cutting blade is seldom broken so that the label cutting can be performed in good order for a long period of time.

C. The label applying machine operates quietly as it does not produce impact sounds during cutting work.

D. Tamper-proof labels can be formed.

BRIEF DESCRIPTION OF THE DRAWINGS

In order that the invention may be more fully understood, preferred embodiments and various features will now be described by way of example and with reference to the accompanying drawings, in which.

DETAILED DESCRIPTION OF THE PRIOR ART

Figure 9:
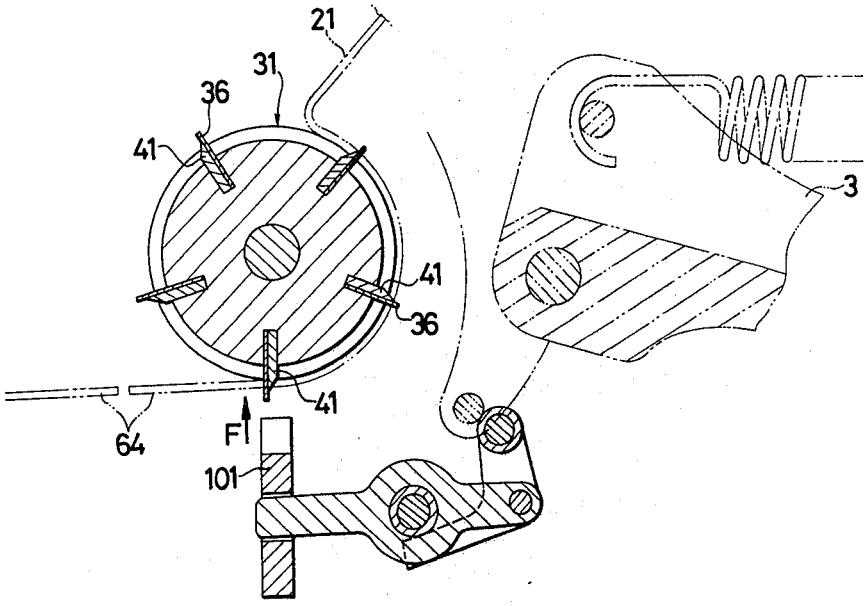
FIG.9 Prior Art
FIG. 9 is a vertical cross-sectional view of a cutting device in the prior art.

FIG. 9 shows a label cutting device in a label applying machine disclosed in the above Japanese Pat. No. 664,072. This label cutting device comprises a label advancing roller 31 having label advancing pawls 36 and cutting blades 41 spaced at regular intervals around the peripheral surface of the roller and comprises a blade receiving block 101 that is disposed below the advancing roller 31 and that is movable in the vertical directions. The blade receiving block 101 is moved in the direction of an arrow F by the operation of a hand lever 3, thereby pressing the blade receiving block 101 against the cutting blade 41 so as to cut the peeled label strip 21 and to obtain a single cut label 64. The disadvantages of this prior art arrangement were discussed above.

DETAILED DESCRIPTION OF THE PREFERRED EMBODIMENTS

In FIGS. 1 to 7, the first embodiment of cutting device of the invention is shown.

Figure 1:
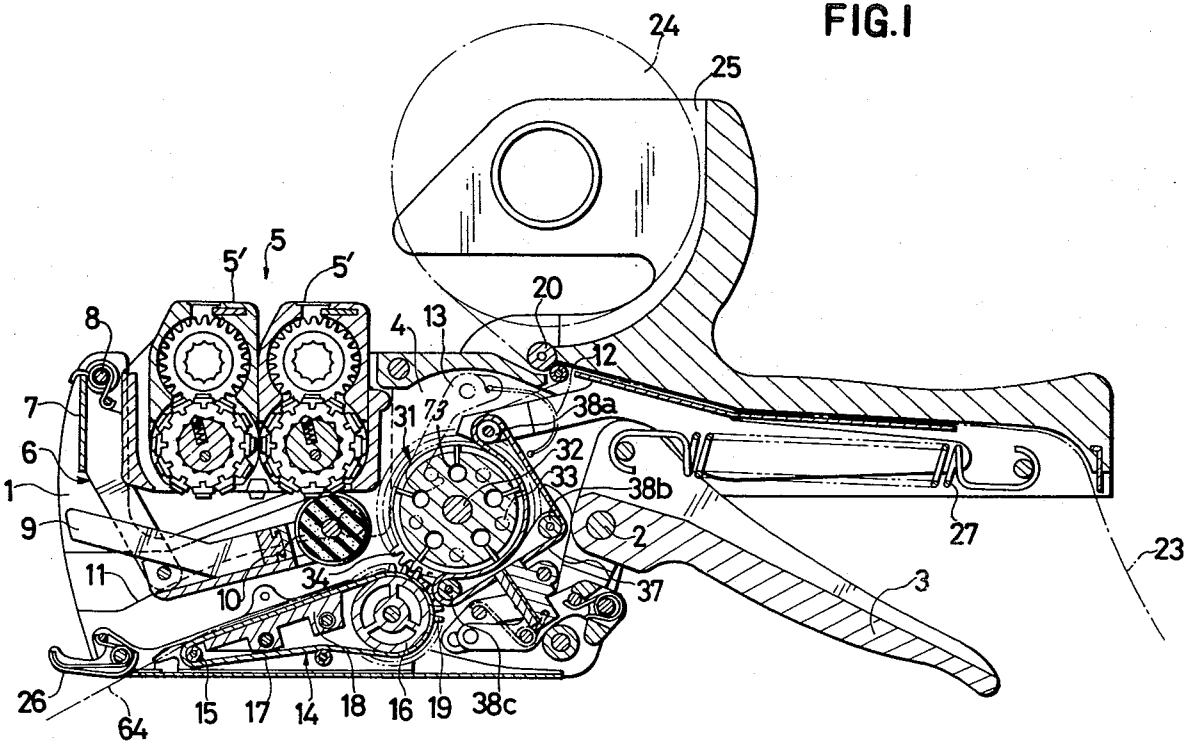
FIG. 1 is a vertical cross-sectional view of a label applying machine, which is provided with the label cutting device of the present invention.

The label applying machine of FIG. 1 has a pair of side plates 1 disposed on both sides of a label applying machine leaving a space between the side plates to receive the component parts of the machine. A hand lever 3 is pivotally secured to a fulcrum shaft 2 that is attached between the side plates 1. A drive spring 27 normally biases the hand lever 3 to pivot to its ungripped condition of FIG. 1 away from the grip toward which the lever is pivoted when gripped. The front half of the hand lever 3 is a forked yoke 4 that supports a printing head 5 comprised of two printing devices 5'.

There is an inking device 6 for applying ink to the printing head 5. The inking device 6 comprises a bail member 7 and an inking roller 10 that is attached to the bail member 7 by means of an inking roller holder 9. The upper end of the bail member 7 is attached to the pin 8 that bridges the space between the side plates 1. The inking roller holder 9 is detachable from the bail member 7, and the inking roller 10 is also detachable from the inking roller holder 9. Upon the downward stroke of the printing device 5 caused by the squeezing of the hand lever 3, the inking roller 10 rolls over the type faces of the printing types in the printing head 5 and this inks the type faces. The inking roller 10 is moved along the guide grooves 11 which are formed in the inside walls of the side plates 1.

Figure 2:
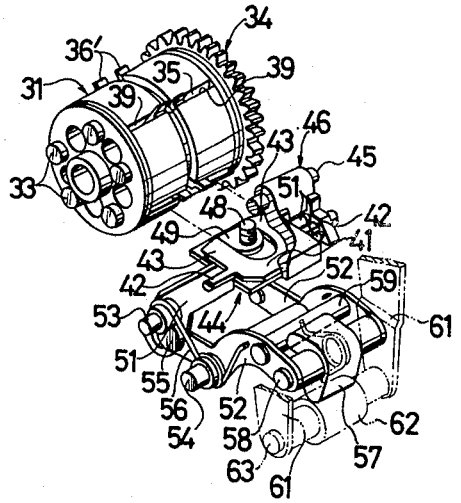
FIG. 2 is a perspective view of the main part of the cutting device of the present invention.

The label cutting device of the present invention includes a label advancing roller 31 which is rotatably supported by a main shaft 32 that is attached between the side plates 1. As shown in FIG. 2, a plurality of indexing pins 33 are formed at regular intervals on one side of the advancing roller 31. A hook lever 13 (FIG. 1) is engaged with the indexing pins 33 one by one. The hook lever 13 is pivotally attached to the yoke 4 at the front portion of the hand lever 3. The lever 13 is actuated by a spring 12 which biases lever 13 counterclockwise in FIG. 1. A gear 34 is affixed on the other side of the advancing roller 31 from pins 33. The gear 34 is in engagement with gear 19. The gear 19 is secured to a large roller 16 at the rear portion of a label transferring belt device 14 which is disposed below the printing head 5.

The label transferring belt device 14 is comprised of a large roller 16 and a small roller 15 which carry an endless belt 17 that is surface treated with silicone resin. The belt device is supported on platen belt frame 18. The belt device 14 is interconnected through the gears 19 and 34 to the advancing roller 31.

The belt device 14 delivers peeled, cut labels to the label applicator 26 at the front of the labeling machine and the applicator applies the labels to commodities.

Figure 3:
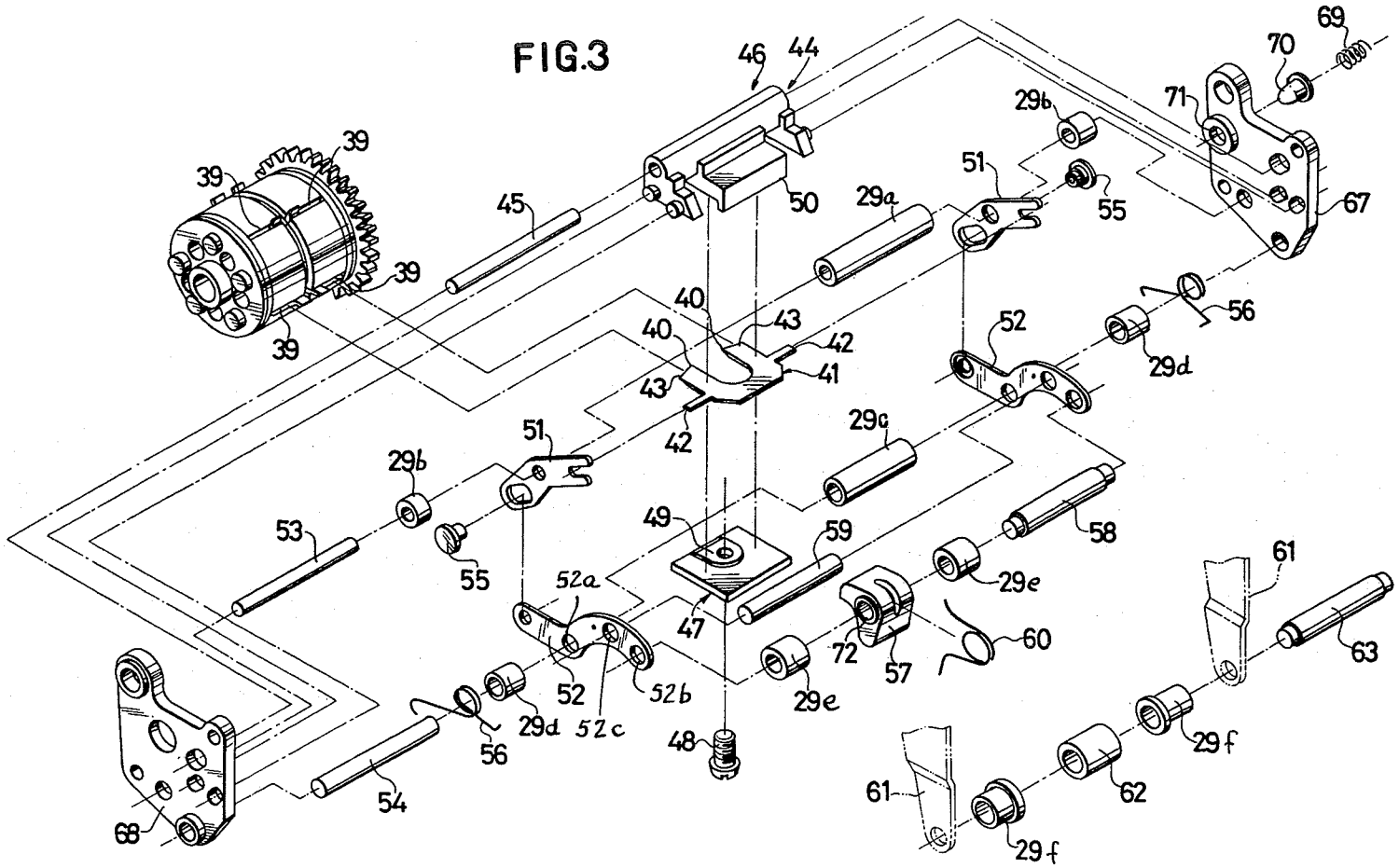
FIG. 3 is an exploded perspective view of the component parts of the cutting device shown in FIG. 2.

On the outer wall of the gear 34, there are a plurality of positioning recesses disposed in a circle (not shown in drawings). In FIG. 3, auxiliary side plates 67, 68 are illustrated. These are attached to respective side plates 1. As shown in the upper right part of FIG. 3, a projection 70 is fitted into a fitting hole 71 formed in the auxiliary side plate 67 and the projection 70 is urged into hole 71 by a spring 69 that also presses against the adjacent side plate 1. The angular positioning of the advancing roller 31 is obtained through engagement between one of the above recesses in the wall of gear 34 and the projection 70 on the auxiliary side plate 67 that is attached on a side plate 1.

The label strip to be operated upon by this apparatus comprises adhesive backed labels joined at perforations and laminated to a separate layer of removable protective backing paper 23. As shown in FIG. 1, the laminated label strip and backing paper 24 are held on and dispensed from a holder 25 at the top of the frame. After peeling of the label strip 21 from the backing paper strip 23, the peeled label strip 21 is pressed against the peripheral surface of the advancing roller 31 by elastic pressure belts 37 which pass around rollers **38*a*, 38*b* and 38*c* which are supported on side plates 1**.

Figure 4:
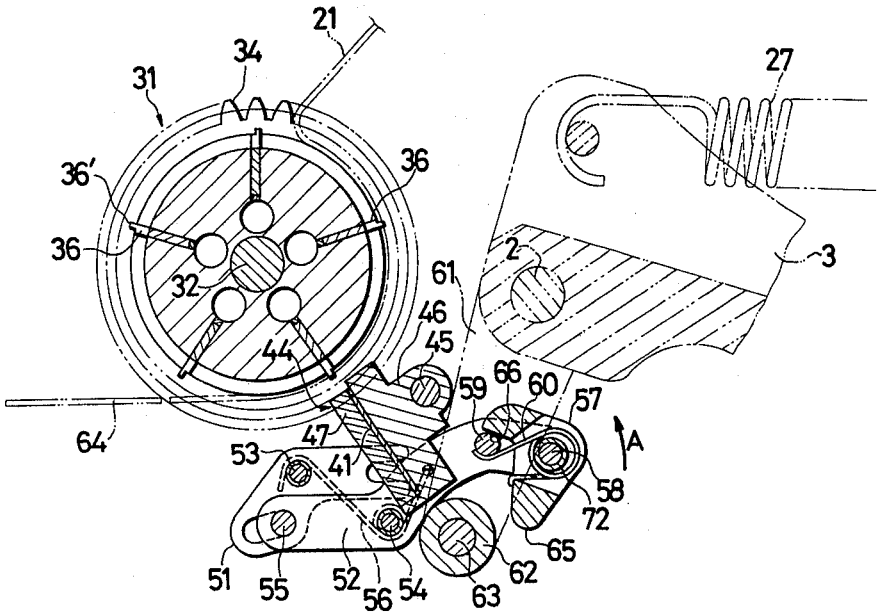
FIG. 4 is a vertical cross-sectional view of the cutting device in which the hand lever of the label applying machine is released.
Figure 7:
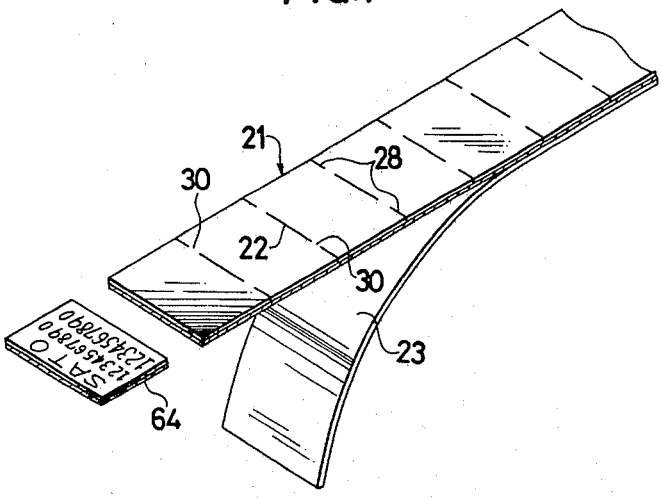
FIG. 7 is a perspective view of a portion of a label strip.

Referring to FIGS. 2 and 4, long grooves 35 are formed at regular angular intervals in the outer surface of the advancing roller 31 and extend across the roller 31 in the direction parallel to the axis of the roller. Inserted into each long groove 35 is a label advancing pawl 36 that has two radially outwardly projecting pawl tips 36' in its upper middle portion. The width of the two pawl tips 36' between both ends thereof corresponds to the length of the transferring perforation 22 which extends across the middle portion of the label strip 21, as shown in FIG. 7. The label strip 21 has side cuts 28 extending in from its sides and it has unbroken connecting portions 30 which join the side cuts 28 and the corresponding perforation 22.

Referring to FIG. 3, at both outer side portions of the long grooves 35 of the advancing roller 31 alongside the pawl tips 36' are formed blade receiving slots 39 which have adequate widths and depths for receiving the inward, free sharpened cutting blade edges 40 of a label cutting blade 41.

At the bottoms of slots 39, there are dusting holes 73 which accept the cutting waste or chad.

As shown in FIGS. 2–4, there is a single label cutting blade 41 which is a U-shaped plate having sideways projecting lugs 42 on both sides and including arms 43 with blade edges 40 at their tip ends. Further, the blade 41 is movably carried by a cutting blade support 44.

The cutting blade support 44 comprises an upper supporting member 46 and a lower supporting member 47. The upper supporting member 46 is attached to and extends between the side plates 1 through engagement with the auxiliary side plates 67 and 68 and by means of a shaft 45 that extends through supporting member 46 and into plates 67 and 68. The lower supporting member 47 has a raised portion 49 on its top which is slightly higher than the thickness of cutting blade 41. The raised portion 49 of the lower supporting member 47 is attached to the upper supporting member 46 with a screw 48 that is received in a threaded hole (not shown) in member 46. The raised portion 49 guides the edges 40 on the arms 43 of cutting blade 41 exactly into the blade slots 39 of the advancing roller 31. Both of the outer side walls of the raised portion 49 are parallel to both opposed inside walls of the arms 43 of the cutting blade 41 and the outer walls of portion 49 contact the inside walls of the arms 43. Further, to allow the cutting blade 41 to reciprocate along the length of arms 43, the length of the raised portion along the length of arms 43 is shorter than the length of the arms 43. On the rear lower edge of the upper supporting member 46, there is a stopper 50 (see FIG. 3) for receiving the rear end of the cutting blade 41.

As shown in FIGS. 2 and 3, the lugs 42 at both sides of the cutting blade 41 are fitted in U-shaped notches that are formed in one end of each first link 51. The first links 51 are pivotally secured at their central regions to the auxiliary side plates 67 and 68 with a shaft 53 that extends across the space between plates 67 and 68 and through a sleeve **29*a* which properly spaces links 51 apart and narrow sleeves 29*b* which spaces the links from plates 67 and 68. The end portion of each link 51 opposite to its U-shaped notch is pivotally connected to one end of a second link 52 by a respective pin 55**.

Each second link 52 is pivotally attached to the auxiliary side plates 67, 68 and to side plates 1 by a shaft 54 that passes through the more central opening through link 52 and through central sleeve **29*c*, which spaces links 52 apart and narrow outer sleeves 29*d* which spaces links 52 from plates 67 and 68. As shown in FIGS. 3 and 4, the second links 52 are urged clockwise by torsion springs 56 that are biased by their engagement with shafts 53 and 54**.

In its normal position, the cutting blade 41 supported by the first links 51 is always held in its lower non-cutting position. The other ends (the right ends in FIG. 4) of the second links 52 carry a rotatable member 57, shaped like a bell crank, which is attached to the links 52 by a shaft 58 that extends between the auxiliary plates 67 and 68 and that passes through openings 52*b* in links 52, through the central bent portion of member 57, and the spacer sleeves 29*e* between member 57 and links 52 that define the central location of member 57. Member 57 is normally urged counterclockwise in the direction of arrow A in FIG. 4 by a spring 60 that is fitted on a roller 72 in the opening through member 57. The spring 60 engages the member 57 and the underside of a bar 59. The front undersurface 66 of the rotating member 57 is biased by spring 60 into contact with a bar 59 that extends between the second most rearward holes 52*c* through the second links 52.

On both sides of the hand lever 3, vertical arms 61 are rotatably attached to the fulcrum shaft 2. The lower free ends of the arms 61 are joined by a pin 63. The pin 63 passes through holes at the ends of arms 61, a central roller 62 and spacing elements 29*f*. The roller 62 is attached to move with the lower free ends of the arms 61 by the pin 63. The roller 62 is brought into engagement with the lower end 65 of the rotatable member 57 for rotating same, as described below.

Figure 5:
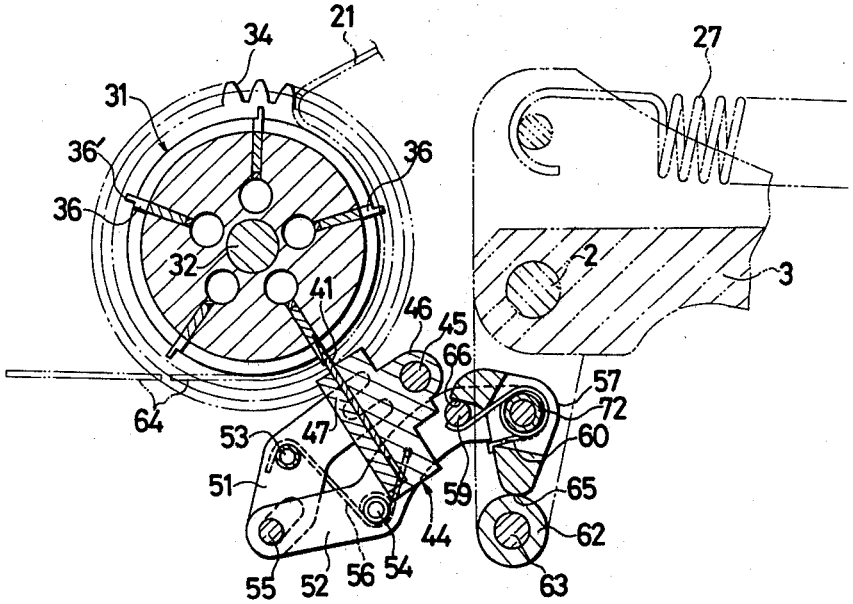
FIG. 5 is a vertical cross-sectional view of the cutting device in which the hand lever of the label applying machine is partially squeezed.

The operation of this embodiment of the cutting device will be described with reference to FIGS. 4 to 6.

FIG. 4 shows the inoperative condition before lever 3 is squeezed. As shown in FIG. 5, when the hand lever 3 is squeezed halfway, the vertical arms 61 of the hand lever 3 turn counterclockwise about the fulcrum shaft 2 and the upper surface of the roller 62 at the tip ends of the arms 61 pushes the lower end 65 of the rotatable member 57 in the rearward direction and then raises the member 57 and this rotates the member 57 counterclockwise around shaft 58. Because the front undersurface 66 of the rotatable member 57 is held in contact with the bar 59 between the second links 52, the second links 52 are turned counterclockwise about the shaft 54 against the force of the spring 56 by the spring 60. This turns the first links 51 counterclockwise about the shaft 53. As a result, the cutting blade 41, which is carried by the first links 51, is moved forward through the stationary supporting member 44. The edges 40 of the cutting blade 41 enter the blade slot 39 of the long groove 35 of the advancing roller 31 that is then opposed to blade 41.

With regard to the label strip 21 at this position, the transferring perforation 22 of the strip is in engagement with the advancing pawls 36 of the advancing roller 31 and the label strip 21 is pushed over the peripheral surface of the advancing roller 31 by the spring belts 37. By means of the blade 41, the connecting portions 30 on both sides of the perforation 22 are cut off, thereby severing the connection between adjacent labels and separating a single label 64.

Figure 6:
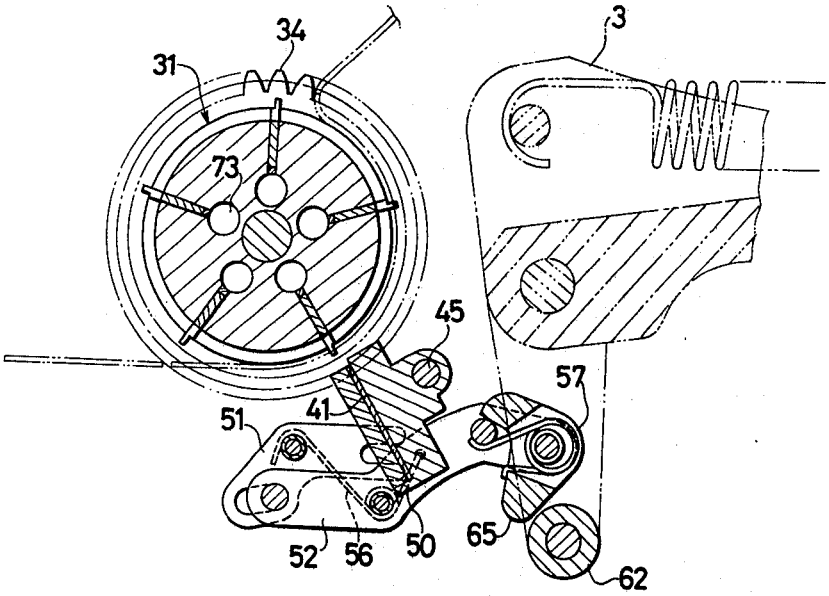
FIG. 6 is a vertical cross-sectional view of the cutting device in which the hand lever of the label applying machine is completely squeezed.

When the hand lever 3 is further squeezed, as shown in FIG. 6, the roller 62 passes completely under the lower end 65 of the rotating member 62, freeing the second links 52 to be returned clockwise by the force of torsion springs 56. This also returns the first links 51 clockwise, and the cutting blade 41 is pulled down through the action of the first links 51. In this return of the blade 41, its rear side is stopped by the stopper 50 of the support 44.

After the label strip 21 is cut, when the hand lever 3 is released, the roller 62 held by the tip ends of the vertical arms 61 is moved forwardly under the lower end 65 of the rotating member 57 by the tension of drive spring 27, and the rotatable member 57 is turned clockwise against the force of the spring 60 by the combined action of the roller 62 engaging member 57 from the rear and the then stationary rod 59. When the roller 62 passes the lower end 65, the roller 62 and the lower end 65 of member 57 are completely disengaged and the roller 62 returns to the original position shown in FIGS. 1 and 4.

Before the label strip 21 reaches the roller 31, the strip 21 of labels is peeled from the backing paper 23 at the guide roller 20 which is disposed below the label holder 25. The backing paper is led through an outlet passage to the rear of the hand grip. The label strip 21 is then inserted into the space between the outer surface of the advancing roller 31 and the elastic belts 37, and here the transferring perforations 22 of the label strip 21 are engaged by the advancing pawls 36 of the advancing roller 31. During the rotation of the advancing roller 31, the projection 70 for positioning the roller 31 engages the recesses (not shown) formed on the side face of the advancing roller 31. The advancing roller 31 is thus turned for the length of a single label 64 during each cycle of operation of the hand lever and the label strip 21 is transferred to the cutting position one label at a time. Each cut label 64 is then transferred from the advancing roller 31 to the label transferring belt device 14. While each label is on this device, it is printed by the printing head 5 that is placed above the platen belt frame member 18. The printed label is delivered under the label applying member 26 which can then apply it to a commodity.

A different embodiment of cutting device is now described. All elements not described below are the same as in the first embodiment.

Figures 8A, 8B, 8C:
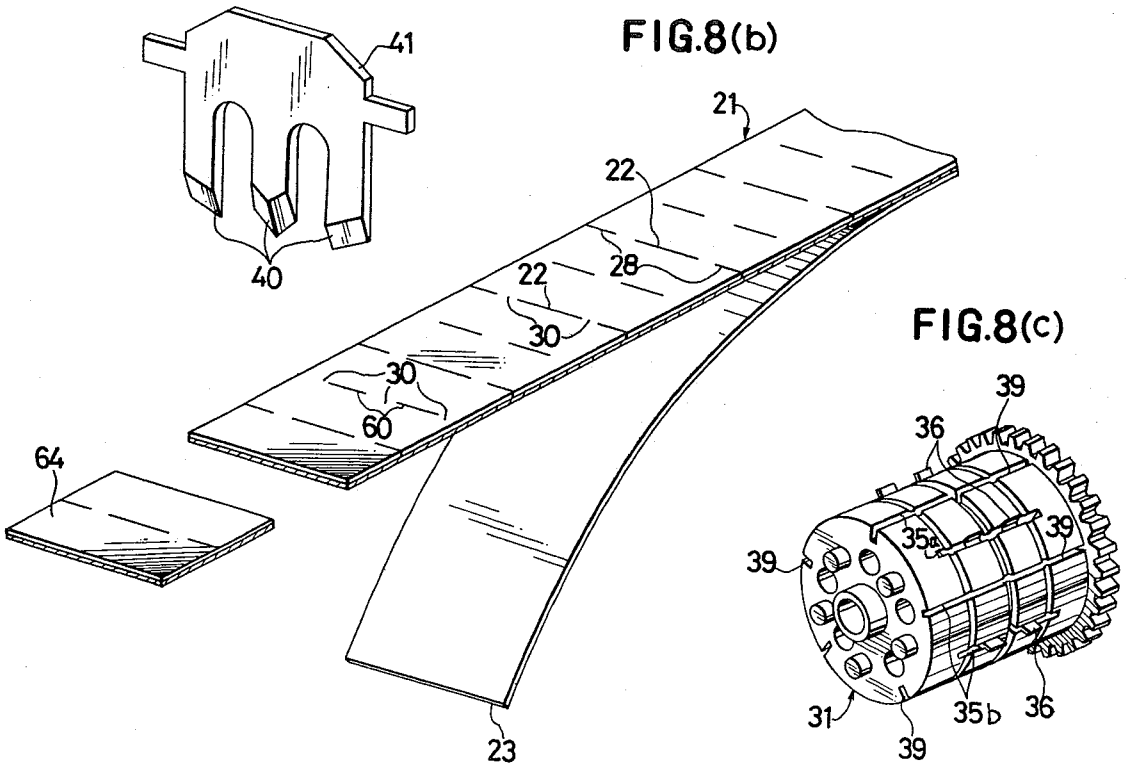
FIG. 8*a* is a perspective view of a modified embodiment of a cutting blade for a cutting device.
FIG. 8*b* is a perspective view of a portion of a modified embodiment of a label strip.
FIG. 8*c* is a perspective view of a modified embodiment of a label advancing roller.

FIG. 8*c* shows another embodiment of the advancing roller 31, in which the long transverse grooves 35*a* for blade slots 39 and the shorter transverse grooves 35*b* for advancing pawls 36 are separately formed in the outer surface of the advancing roller 31 and are angularly spaced apart around the periphery of roller 31 at regular intervals. The grooves 35*b* having advancing pawls 36 are spaced apart at the same intervals, but they are placed between the grooves 35 for the pawls 36.

In the modified embodiment of the label strip 21 shown in FIG. 8*b*, which is to be used with the roller 31 of FIG. 8*c*, there are spaced apart transverse rows across the label strip 21 consisting of the transferring perforation 22 formed in the middle portion of the strip, the connecting portions 30 formed on both sides of the perforation 22 and the edge cuts 28 formed outside of the connecting portions 30. These rows are formed at regular intervals along the label strip 21. Midway between adjacent perforations 22, there are auxiliary cuts 60 which are spaced at the same intervals as the above described rows. There are also uncut connecting portions 30 formed between and on both sides of the auxiliary cuts 60.

The modified embodiment of a cutting blade 41 shown in FIG. 8*a* is M-shaped, with three blade edges 40 formed at the lower portion of the blade 41. The number of blade edges corresponds to the number of uncut sections 30 of label material at auxiliary cuts 60 which the blade 41 must cut.

A single modified label 64 is cut off by inserting the blade edges 40 through the connecting portions 30 and into the blade slots 39 of a long groove 35*a* when an arrangement of cuts 60 and uncut portions 30 are indexed under blade edges 40 and over a blade slot 39. The resulting label 64 has three cuts (a perforation 22 and tamper-proof edge cuts 38) remaining at its middle portion. A label 64 having tamper-proof cuts 38 is useful, for instance, when a customer who seeks to buy a high priced commodity at a lower price, peels a low price label off an inexpensive commodity intending to attach the peeled label to an expensive commodity in place of the higher price label that he has also peeled off. However, each applied label is torn at the above mentioned three cuts 28, 22, 28 when it is peeled off, whereby the customer cannot succeed in his attempt. In other words, when the grooves for the blade slots and for the advancing pawls are separately formed, tamper-proof labels can be produced.

Although the present invention has been described in connection with a number of preferred embodiments thereof, many variations and modifications will now become apparent to those skilled in the art. It is preferred, therefore, that the present invention be limited, not by the specific disclosure herein, but only by the appended claims.

I claim:

1. A label cutting device for a label applying machine, comprising:

an operating lever movable between a first and a second position;

a roller connected to said lever for being rotated thereby as said lever is moved to one of its said positions; said roller having a periphery; a blade receiving means defined in said roller periphery; said roller being rotatable to bring said blade receiving means to a cutting position;

a cutting blade held nonrotatively stationary with respect to rotation of said roller and positioned at said cutting position; said cutting blade being movable toward and into engagement with said blade receiving means when said roller has rotated to position said blade receiving means at said cutting position; said cutting blade being connected to said lever so as to be reciprocatingly moved toward and away from engagement with said blade receiving means as said lever is moved;

means for moving a label strip which is to be cut against said roller at said cutting position.

2. The label cutting device of claim 1, wherein said blade receiving means comprises a groove defined in said roller periphery and extending across said roller; said cutting blade being oriented to enter said groove as it is moved to said groove by said lever.

3. The label cutting device of claim 2, wherein there are a plurality of said grooves spaced at intervals around said roller periphery; means for moving each said groove, in turn, to said cutting position as said lever is operated.

4. The label cutting device of claim 2, further comprising a linkage connected between said lever and said blade for moving said blade as said lever is moved.

5. The label cutting device of claim 2, further comprising label strip advancing means on said roller periphery for engaging a label strip which is held against said roller periphery by said means for moving a label strip, whereby the label strip moves with said roller.

6. The label cutting device of claim 5, wherein said cutting blade comprises a plurality of arms projecting toward said groove, and said arms having sharpened edges facing toward said groove for piercing label strip material as said blade edges move into said groove.

7. The label cutting device of claim 5, wherein said label strip advancing means comprise pawls projecting out of said roller periphery for engaging the label strip.

8. The label cutting device of claim 5, further comprising means for holding a label strip against said roller periphery at least in the vicinity of said cutting position.

9. The label cutting device of claim 8, further comprising a label transfer device located to receive labels after they have been cut to remove them from the vicinity of said roller.

10. The label cutting device of claim 5, wherein said label strip advancing means is spaced from said roller groove around said periphery of said roller.

11. The label cutting device of claim 10, wherein there are a plurality of said grooves spaced at intervals around said roller periphery; means for moving each said groove, in turn, to said cutting position as said lever is operated.

12. The label cutting device of claim 11, wherein said label strip advancing means comprises pawls projecting out of said roller periphery for engaging the label strip.

13. The label cutting device of claim 12, wherein there are a plurality of said label strip advancing means spaced at intervals around said roller periphery; said label strip advancing means being located in the intervals between adjacent said roller grooves.

14. The label cutting device of claim 5, further comprising a linkage connected between said lever and said blade for moving said blade as said lever is moved.

15. The label cutting device of claim 14, further comprising a supporting plate on which said roller is pivotally mounted for rotation with respect to said plate; said lever being supported by and being movable between its said positions with respect to said plate.

16. The label cutting device of claim 15, wherein said lever is pivotally attached to said plate and said linkage is adapted to translate pivotal motion of said lever into motion of said cutting blade toward, into, out of and away from said groove.

17. The label cutting device of claim 15, further comprising blade supporting means which is supported on said supporting plate and which includes blade guide means that are engaged by said blade for guiding said blade toward and into and out of said roller groove as said blade is so moved by said linkage.

18. The label cutting device of claim 17, wherein said cutting blade comprises a plurality of arms projecting toward said groove, and said arms having sharpened edges facing toward said groove for piercing label strip material as said blade edges move into said groove.

19. The label cutting device of claim 15, wherein said linkage comprises a first link having one end portion and its said one end portion being pivotally attached to a second link; said first link having another end portion and said blade being attached at and supported by said first link other end portion, such that said first link pivots around its said first end portion to move said blade into and out of said roller groove; said first link being pivotally connected to said supporting plate at a pivot intermediate its said end portions;

a second link; said second link being pivotally attached to said supporting plate; said first link being pivotally attached to said second link at a pivot spaced from the said pivot connection of said second link to said supporting plate, whereby pivoting of said second link with respect to said supporting plate pivots said first link;

link pivot means joining said lever to said second link for pivoting said second link as said lever is pivoted.

20. The label cutting device of claim 19, wherein said link pivot means comprises a bell crank shaped element having one arm engageable with said second link to pivot same to move said first link to move said blade out of said groove;

said bell crank shaped element having another arm engageable by said lever upon said lever moving toward one of its said positions, to raise said bell crank shaped element to move said second link to pivot said first link to move said blade toward said groove.

21. The label cutting device of claim 20, further comprising biasing means for biasing said second link to pivot said first link to move said blade out of said groove.

22. A label cutting device for a label applying machine, comprising:

an operating lever movable between a first and a second position;

a roller connected to said lever for being rotated thereby as said lever is moved to one of its said positions; said roller having a periphery; a blade receiving means defined in said roller periphery; said roller being rotatable to bring said blade receiving means to a cutting position;

a cutting blade positioned at said cutting position and being movable toward and into engagement with said blade receiving means when said blade receiving means is at said cutting position; a linkage connected between said lever and said cutting blade for moving said cutting blade toward and away from engagement with said blade receiving means as said lever is moved;

means for moving a label strip which is to be cut against said roller at said cutting position;

a supporting plate on which said roller is pivotally mounted for rotation with respect to said plate; said lever being supported by and being movable between its said positions with respect to said plate.

23. The label cutting device of claim 22, further comprising a blade supporting means which is supported on said supporting plate in a manner which precludes rotation of said blade supporting means with respect to said plate; said blade supporting means including blade guide means that are engaged by said blade for guiding said blade toward and into and out of said blade receiving means as said blade is so moved by said linkage.

24. The label cutting device of claim 22, wherein said lever is pivotally attached to said plate and said linkage is adapted to translate pivotal motion of said lever into motion of said cutting blade toward, into, out of and away from said blade recieving means.

25. A label cutting device for a label applying machine, comprising:

an operating lever movable between a first and a second position;

a roller connected to said lever for being rotated thereby as said lever is moved to one of its said positions; said roller having a periphery; a blade receiving means defined in said roller periphery; said blade receiving means comprising a groove defined in said roller periphery and extending across said roller; said roller being rotatable to bring said blade receiving means to a cutting position;

a cutting blade positioned at said cutting position and being movable toward and into engagement with said blade receiving means when said blade receiving means is at said cutting position; said cutting blade being oriented to enter said groove as it is moved to said groove by said lever; said cutting blade being connected to said lever so as to be moved toward and away from engagement with said blade receiving means as said lever is moved;

means for moving a label strip which is to be cut against said roller at said cutting position;

label strip advancing means on said roller periphery for engaging a label strip which is held against said roller periphery by said means for moving a label strip, whereby the label strip moves with said roller;

a supporting plate on which said roller is pivotally mounted for rotation with respect to said plate; said lever being supported by and being movable between its said positions with respect to said plate.

26. A label cutting device for a label applying machine, comprising:

an operating lever movable between a first and a second position;

a roller connected to said lever for being rotated thereby as said lever is moved to one of its said positions; said roller having a periphery; a blade receiving groove defined in said roller periphery and extending across said roller; said roller being rotatable to bring said blade receiving means to a cutting position;

a cutting blade positioned at said cutting position and being movable toward and into engagement with said blade receiving means when said blade receiving means is at said cutting position; said cutting blade being oriented to enter said groove as it is moved to said groove by said lever; said cutting blade being connected to said lever so as to be moved toward and away from engagement with said blade receiving means as said lever is moved;

means for moving a label strip which is to be cut against said roller at said cutting position;

label strip advancing means on said roller periphery for engaging a label strip which is held against said roller periphery by said means for moving a label strip, whereby the label strip moves with said roller;

means for holding a label strip against said roller periphery at least in the vicinity of said cutting position;

a label transfer device located to receive labels after they have been cut to remove them from the vicinity of said roller;

a printing device and means connected with said printing device and said label transfer device so that said transfer device and said printing device for movable with respect to each other so that said printing device contacts a label on said transfer device as said lever is moved.

* * * * *